US006629327B2

(12) United States Patent
Adams

(10) Patent No.: US 6,629,327 B2
(45) Date of Patent: Oct. 7, 2003

(54) COMBINED CUTTING AND CLIPPING TOOL FOR SEALED BAGS

(76) Inventor: Thomas F. Adams, 3961 E. River Dr., Fort Myers, FL (US) 33916

( * ) Notice: Subject to any disclaimer, the term of this patent is extended or adjusted under 35 U.S.C. 154(b) by 0 days.

(21) Appl. No.: 09/850,712

(22) Filed: May 7, 2001

(65) Prior Publication Data

US 2002/0162174 A1 Nov. 7, 2002

(51) Int. Cl.[7] ..... B26B 11/00

(52) U.S. Cl. ..... 7/158; 7/170; 24/30.5 R; D8/395

(58) Field of Search ..... 7/156, 160, 170, 7/169; 24/30.5 R, 30.5 S; D8/395

(56) References Cited

U.S. PATENT DOCUMENTS

| | | | | |
|---|---|---|---|---|
| 4,356,600 A | | 11/1982 | Welch | |
| 4,394,791 A | | 7/1983 | Groth | |
| 4,455,894 A | | 6/1984 | Roberts | |
| 4,602,397 A | * | 7/1986 | Chao | 7/158 |
| D296,729 S | * | 7/1988 | Blanchard | D8/395 |
| D303,216 S | | 9/1989 | Hoffman et al. | |
| 5,267,374 A | | 12/1993 | Drake | |
| 5,305,500 A | | 4/1994 | Tucker | |
| 5,875,503 A | | 3/1999 | Cheldin | |
| 6,065,169 A | * | 5/2000 | Cheldin | 7/158 |
| 6,105,217 A | * | 8/2000 | Caradine et al. | 24/30.5 R |

OTHER PUBLICATIONS

Bag Clip Product of Tangibles, Ltd. of Etdbicoke ON Canada M9V 3Y8 Date Unknown; on Market Since Before May 6, 2000.

Opener Product of Tangibles, Ltd. of Etdbicoke, ON Canada M9V 3Y8 Date Unknown; on Market Since Before May 6, 2000.

Envelope Opening Device of Keene, Verona, WI 53593. First Date Unknown. on Market Since Before May 6, 2000.

* cited by examiner

*Primary Examiner*—D. S. Meislin
(74) *Attorney, Agent, or Firm*—Peter D. Keefe

(57) ABSTRACT

A tool having a combined synergistic function for users of sealed plastic bags in order to quickly and safely open and reseal them, wherein a cutting tool for cutting the bag open is connected with a clipping tool for clipping closed the opening.

18 Claims, 8 Drawing Sheets

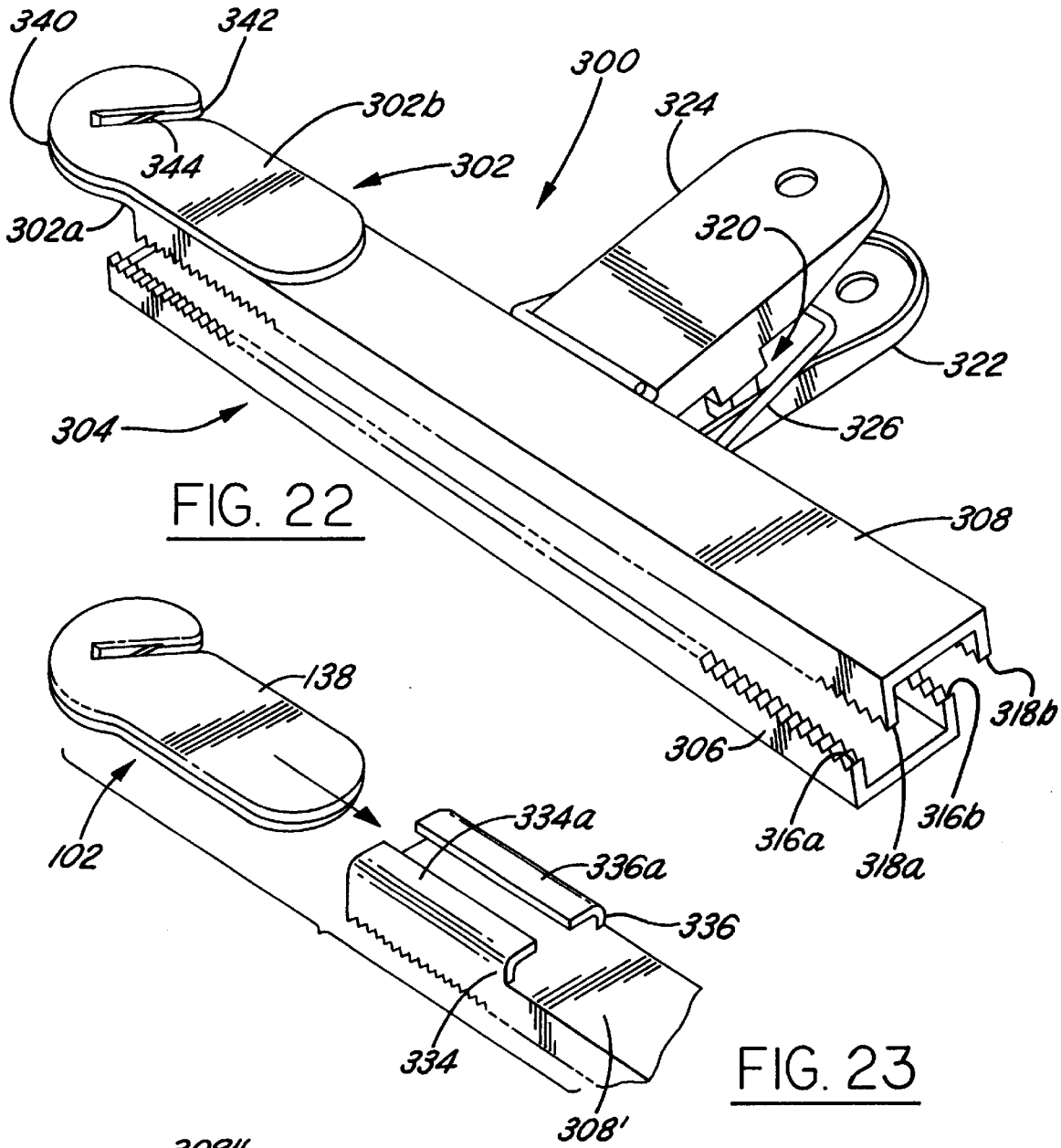
FIG. 22
FIG. 23
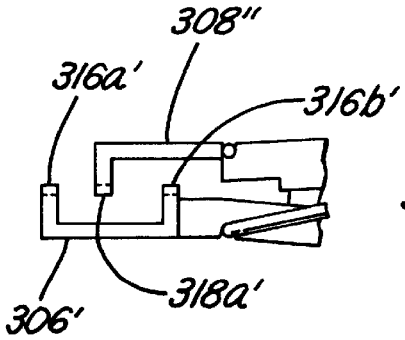
FIG. 24
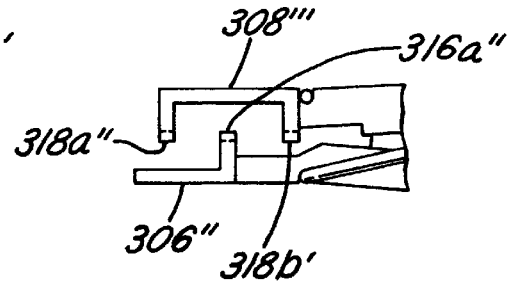
FIG. 25

COMBINED CUTTING AND CLIPPING TOOL FOR SEALED BAGS

BACKGROUND OF THE INVENTION

1. Field of the Invention

The present invention relates to sealed plastic bags of the type used to hold loose articles, such as food, and more particularly to a tool which provides selective cutting open and subsequent clipping closed the opening in the bag.

2. Description of the Prior Art

Sealed bags for loose articles, such as for example snack foods and breakfast cereals, are marketed in the form of a bag which has an upper seal, and is typically constructed of plastic (sometimes cereal boxes have therewithin sealed bags composed of wax paper). In the case of plastic bags, the plastic is quite strong and the seam is in the nature of a strong weld which provides a hermetic seal for the contents. The manufacturer expects the user to be able to open the sealed bag by either tearing the seam, cutting the seam with a knife or scissors, or by brute force peeling it apart at the seam. Peeling apart the seam is difficult for an able-bodied person, but it is quite frustrating for children and disabled persons. And, once the bag has been opened, frequently the entire contents are not dispensed at the time of opening, introducing a sealing problem because the seam is not self re-sealing. Also, the use of tamper-proof sealed bags has become increasingly prevalent, with even more difficulty being associated with opening them.

In the art, it has become now ubiquitous to utilize a spring-loaded bag clip (or bag clamp), as described for example by U.S. Pat. No. 4,294,791. One example of a prior art bag clip is shown at FIG. 1. The bag clip 10 has a pair of elongated jaws 12, 14 which are pivotably connected at a rocking pivot 16 and biased closed by action of a spring 18. A handle 20 is connected to each of the jaws and allows a user to manipulate the bag clip 10. In operation, the jaws are opened, placed along the open seam and then clamped thereupon to reseal the bag. The jaws preferably terminate in a frictional surface, such as soft plastic tubes (which is a costly design/construction), or terminate in a rows of interengaging serrations. A second example of a prior art bag clip is shown at FIG. 2. The bag clip 22 has a first wing 24 and a second wing 26, each terminating at one end in a jaw 28, 30, respectively, and at the other end in a handle 32. A living hinge 34 provides a pivot, and a spring 36 provides a clamping action at the jaws. Operation is similar to the first example.

Specialized devices to cut open sealed packages are known. For example, FIG. 3 shows a prior art envelope opening device 38. The opening device 38 has a main body 40 having a slot 42 into which is resident a blade 44. The blade is at an acute angle relative to the slot so that any thin planar, fibrous paper-type material entering the slot will encounter the blade at a cut facilitating incidence. The slot is defined at one side by a piercing member 46. A tongue 48 may be present. In operation, the piercing member is used to enter into the space between the envelope proper and its sealed flap. As the fold between the flap and the envelope proper passes into the slot, the blade cuts open the envelope. This device does not, however, work well to cut open plastic bags because the blade is not well positioned relative to the slot for this purpose. Another prior art opener is depicted at FIGS. 4A and 4B. The opener 50 has a body 52 which integrates a head 54 with a handle (or stem) 56. The body 52 is in the form of an upper planar part 58 and a lower planar part 60. The head has a slot 62 which is formed at each of the upper and lower planar parts. A blade 64 is carried by the lower planar part and is seated so as to be at an acute angle relative to the slot for the cutting advantage mentioned hereinabove. With the blade seated, the upper and lower planar parts are connected to each other. Operation to open a plastic bag involves holding the handle and placing a portion of the bag into the slot so that the blade cuts it. This device does not work well to cut through paper, but does work well to cut through a plastic bag because the blade cutting edge is positioned relative to the slot for this purpose.

What remains needed in the art is a tool which provides a user with an ability to both easily open a sealed bag and further to reseal the bag after it has been opened.

SUMMARY OF THE INVENTION

The present invention is a tool which has a combined synergistic function for users of sealed plastic bags in order to open and reseal them.

The cutting and clipping tool according to the present invention is composed of a clipping tool integrated with a cutting tool. The clipping tool includes a pair of jaws which are pivotably connected and springably biased into a closed position. When at the closed position, the jaws provide a clamping force sufficient to hold closed an opening in a bag (rolled or unrolled). The clipping tool has a handle for providing ease of use and may have any of a variety of jaw interfaces, including those conventionally known in the art, and further including off-set configurations which provide a superior S-curve closure to the bag opening than a conventional nose-to-nose closure. The cutting tool is of a generally conventional design (FIGS. 4A, 4B), having a head and a stem connected thereto. The head has a slot having a base whereat a blade is resident, the cutting edge of which being at an inclined angle relative to the slot which is positioned for cutting plastic sheet, forcing a plastic bag to be cut (without bunching-up) as it is passed into the slot.

The cutting tool is attached to the clipping tool so that the slot at the head of the cutting tool is unobstructed by any of the structure of the clipping tool, and further so that the clamping function of the jaws is unobstructed by any of the structure of the cutting tool. The cutting tool is preferably attached to the clipping tool on a jaw or on a handle via a seat receiving the stem; alternatively, the stem may be glued to the clipping tool in absence of the seat.

In operation, a user grasps the cutting and clipping tool and grips the sealed bag to be opened. Then, the user directs an edge of the bag (preferably the top seam) into the slot and causes the blade to cut open the bag. The user then selectively dispenses contents of the bag. To reseal the bag, the user preferably rolls the cut edge once or several times, then grasps the cutting and clipping tool so as to place the jaws over the (preferably rolled-up) cut edge, whereupon the jaws clamp closed the opening in the bag.

Accordingly, it is an object of the present invention to provide a combined cutting and clipping tool for the purposes of cutting open sealed bags and thereafter clipping closed the opening.

This, and additional objects, advantages, features and benefits of the present invention will become apparent from the following specification.

BRIEF DESCRIPTION OF THE DRAWINGS

FIG. 22 is a perspective view of a first variation of a first form of a third embodiment of the cutting and clipping tool according to the present invention, wherein two opposing pairs of serration rows provide an S-curve bag sealing bend.

FIG. 23 is another variation of the first variation of the first form of the third embodiment of the cutting and clipping tool according to the present invention.

FIG. 24 is still another variation of the first variation of the first form of the third embodiment of the cutting and clipping tool according to the present invention, wherein one serration row is shown clamped into the center of an opposing pair of rows of serrations so as to provide a C-curve bag sealing bend.

FIG. 25 is yet another variation of the first variation of the first form of the third embodiment of the cutting and clipping tool according to the present invention, wherein one serration row is shown clamped into the center of an opposing pair of rows of serrations so as to provide a C-curve bag sealing bend.

DETAILED DESCRIPTION OF THE PREFERRED EMBODIMENT

Figure 2:
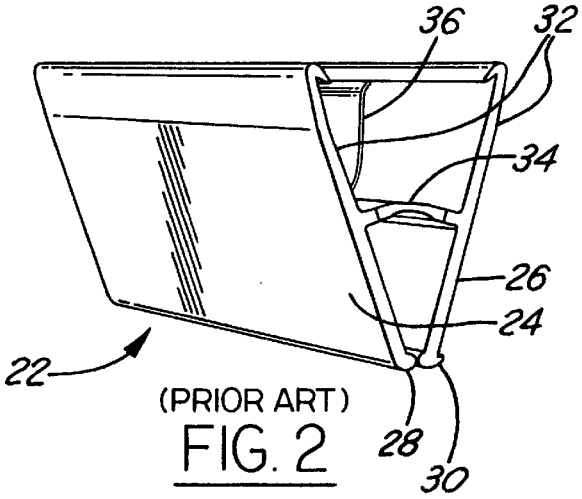
(PRIOR ART) FIG. 2
FIG. 2 is a perspective view of a second prior art clipping device.
Figure 3:
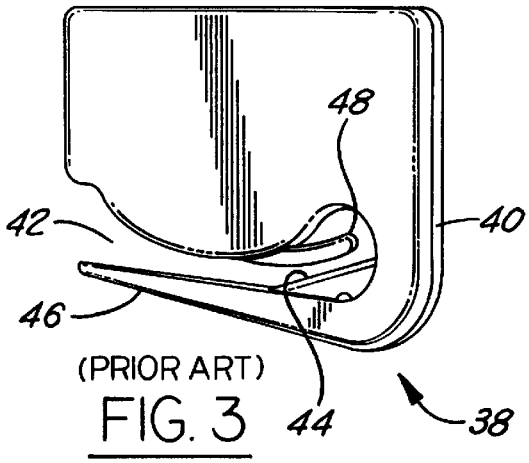
(PRIOR ART) FIG. 3
FIG. 3 is a perspective view of a prior art paper envelope opener.

Referring now to the Drawing, FIGS. 5 through 12 depict a first embodiment of a cutting and clipping tool 100 according to the present invention. The cutting and clipping tool 100 is composed of a mutually attached cutting tool 102 for cutting an opening in a sealed bag and a clipping tool 104 for clamping closed the opening.

Figure 6:
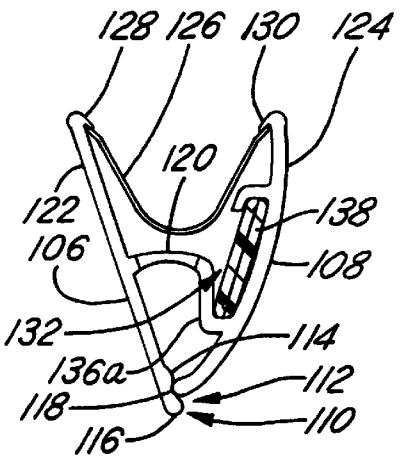
FIG. 6 is a partly sectional end view of the first embodiment of the present invention, seen along line 6—6 of FIG. 8.
Figure 5:
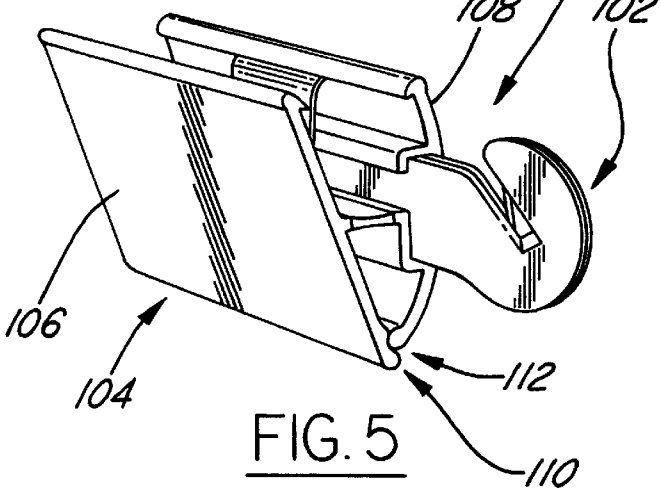
FIG. 5 is a perspective view of a first embodiment of the present invention.

The clipping tool 104 includes a first wing 106 which is somewhat planar, and a second wing 108 which is generally curved (see FIG. 6). At the end of the wings 106, 108 is a respective first and second jaw 110, 112. The first jaw 110 of the first wing 106 is provided with a pair of mutually spaced apart off-set nibs 114, 116. The second jaw 112 of the second wing 108 is provided with a single center-set nib 118. The spacing and location of the nibs is such that the center-set nib 118 is receivable between the off-set nibs 114, 116 when the wings are in a closed state, as shown at FIG. 6.

The wings 106, 108 are interconnected by a living hinge 120, which may be, for example, in the form of a soft elastomer. The living hinge 120 allows the wings 106, 108 to be moved between an open state (see FIG. 11) to the aforesaid closed state. This movement is provided by hand manipulation of handles 122, 124 respectively of the wings 106, 108 (see FIG. 11).

The wings 106, 108 are biased toward the closed state by a spring 126. The spring 126 is preferably of spring steel sheet and is trapped by bosses 128, 130 at an inside surface of the wings 106, 108.

Figure 9:
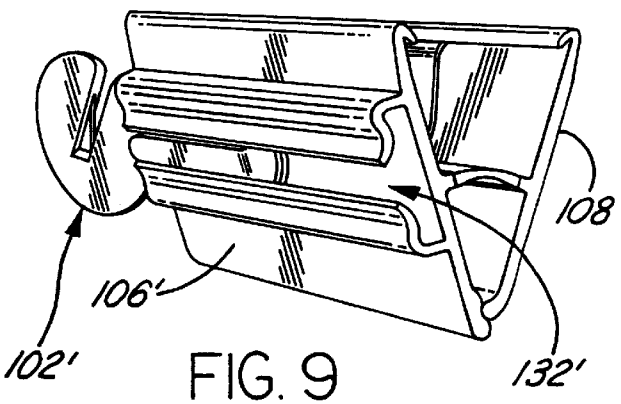
FIG. 9 is an end view of an alternative form of the first embodiment of the present invention.
Figure 7:
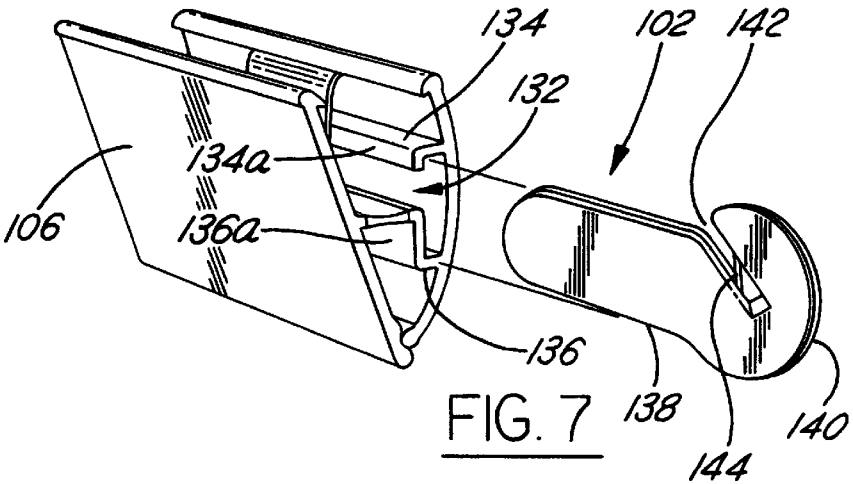
FIG. 7 is a perspective, exploded view of the first embodiment of the present invention.
Figure 26:
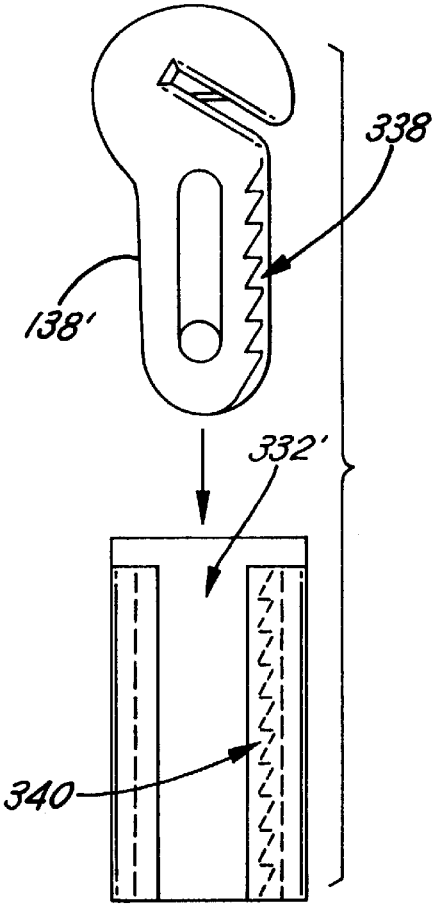
FIG. 26 is an exploded detail plan view of a clipping tool seat according to the present invention.
Figure 27:
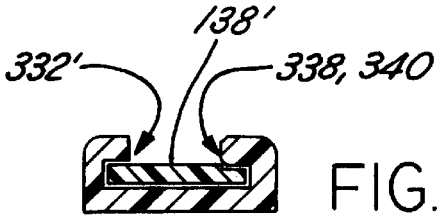
FIG. 27 is a sectional view depicting the clipping tool seat of FIG. 26 in operation with respect to the stem of the clipping tool of FIG. 26.

A cutting tool seat 132 is formed at one of the wings, preferably at the inside surface, but may be located at the outside surface (see cutting tool seat 132' of wing 106' at FIG. 9). The preferred cutting tool seat 132 is a pair of mutually separated rails 134, 136 having lips 134*a*, 136*a* which are structured to receive the stem 138 of the cutting tool 102. The cutting tool seat 132 may hold the stem 138 received therein by friction, by a snap fit, as shown by way of example at FIGS. 26 and 27, (wherein the cutting tool may be replaceable (see FIG. 7) or by being adheringly connected, such as for example by glue, sonic welding or hot staking. As best shown at FIGS. 6 and 7, a lip 136*a* the cutting tool seat 132 may serve as an attachment location for the living hinge 120.

The length of the jaws may be any desired length, ranging for example from about 2.5 inches (as shown) to 6 inches or more. In widths of 4 or more inches, 2 springs are preferred. While the nibs 114, 116, 118 are preferred, there may be only two nibs (one for each jaw) or a pair of mutually spaced apart nibs on each jaw which are off-set relative to each other.

Figure 4B:
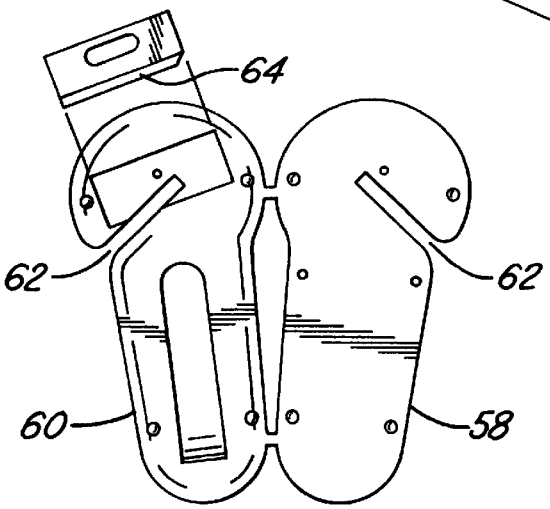
(PRIOR ART) FIG. 4B
FIGS. 4A and 4B are views of a prior art plastic bag opener.
Figure 4A:
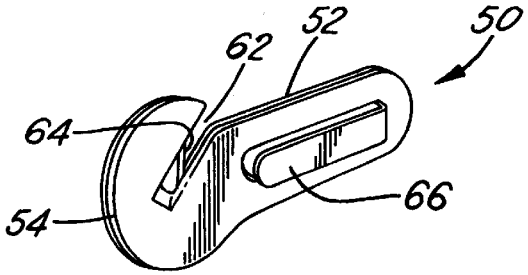
(PRIOR ART) FIG. 4A
Figure 8:
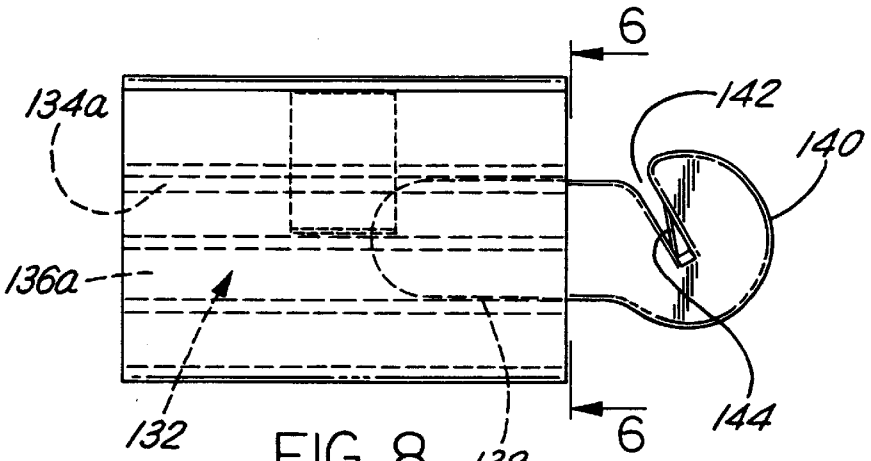
FIG. 8 is a side view of the first embodiment of the present invention.

The cutting tool 102 is similar to the cutting tool described hereinabove with respect to FIGS. 4A and 4B (except a clip 66 is preferably absent, although it may be retained, see alternative cutting tool 102' in FIG. 9), inclusive of two planar parts (see FIG. 17). The cutting tool 102 includes a head 140, the aforesaid stem 138, a slot 142, and a blade 144 (see FIG. 7) having a cutting edge positioned in the slot at an acute angle (which facilitates an easy plastic bag cut, yet is generally child safe).

Figure 10:
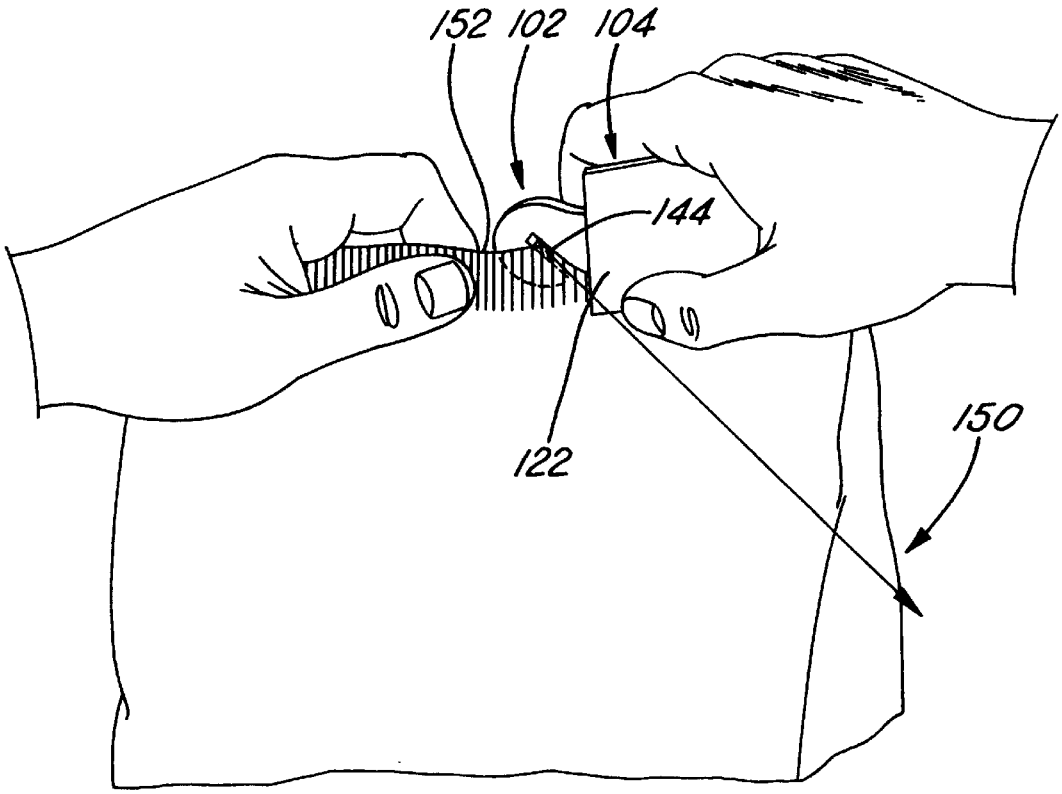
FIG. 10 is a perspective view of the first embodiment of the present invention, shown in operation opening a sealed bag.
Figure 11:
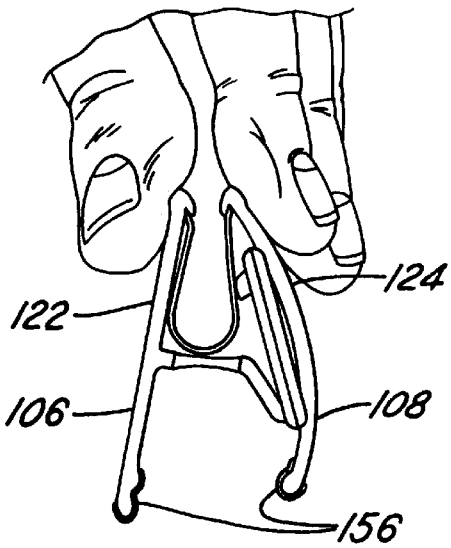
FIG. 11 is a side view of the first embodiment of the present invention, shown in an open state.
Figure 12:
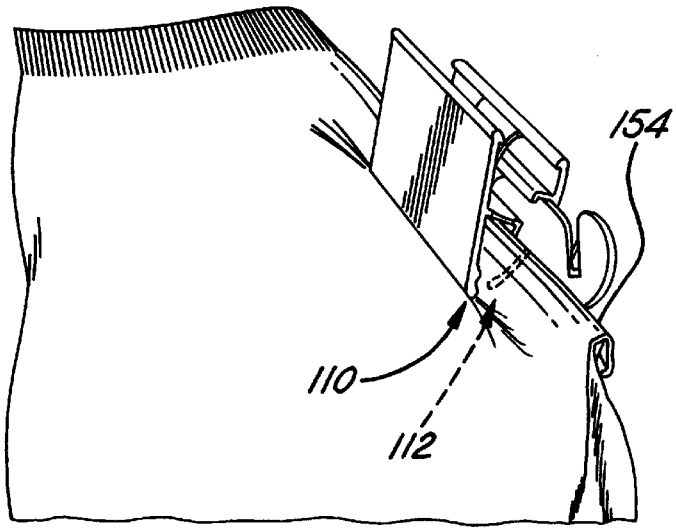
FIG. 12 is a perspective view of the first embodiment of the present invention, shown in a closed state of operation whereby an opening that was formed in the bag of FIG. 10 is held closed by the clipping tool.

Referring now in particular to FIGS. 10 through 12, operation will be detailed. A user grasps the handles (handle 122 being visible) of the clipping tool 104 and grips a sealed bag 150 to be opened. Then, the user directs an edge 152 of the bag into the slot 142 of the cutting tool 102 and causes the blade 144 to cut open the bag. The user then selectively dispenses the contents of the bag. To reseal the bag, the user preferably rolls the cut edge once or several times (see rolled edge 154), then grasps the handles of the clipping tool so as to place the jaws (110, 112) over the rolled bag opening. Next, the jaws are clamped closed upon the opening so as to thereby close the bag. The bag 150 may be of any composition, as for example plastic, wax paper, etc., and may or may not have a weld-type seam as shown.

In order for the jaws to reliably stay clamped on the bag, it is preferred for the nibs 114, 116, 118 to be covered with a soft rubbery material 156 to add friction (see FIG. 11). Preferably in manufacture, the soft rubbery material 156 is co-extruded with the nibs.

Figure 13:
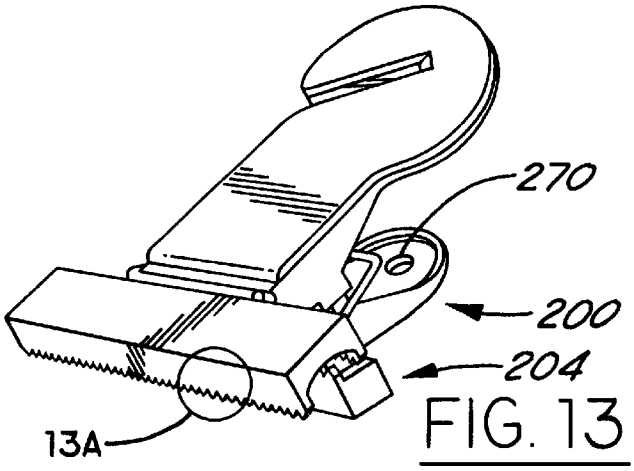
FIG. 13 is a perspective view of a first form of a second embodiment of the cutting and clipping tool according to the present invention.
Figure 14:
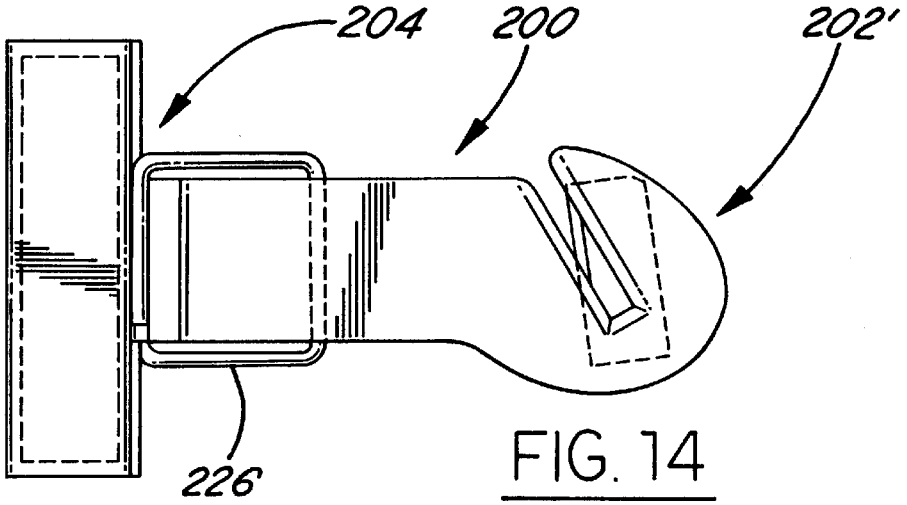
FIG. 14 is a top plan view of the first form of the second embodiment of the cutting and clipping tool according to the present invention.
Figure 15:
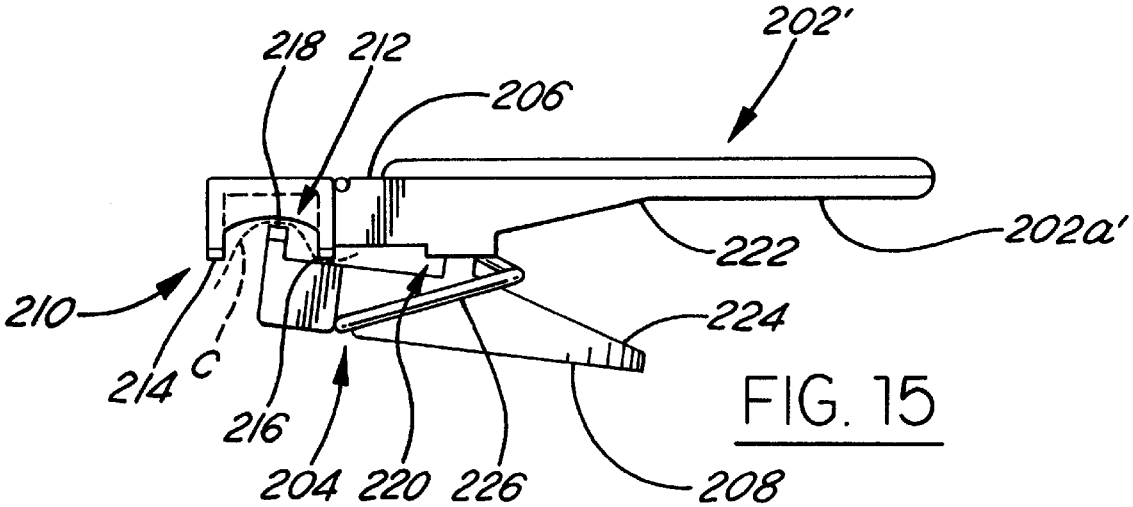
FIG. 15 is a side view of the first form of the second embodiment of the cutting and clipping tool according to the present invention, wherein one serration row is shown clamped into the center of an opposing pair of rows of serrations so as to provide a C-curve bag sealing bend.
Figure 16:
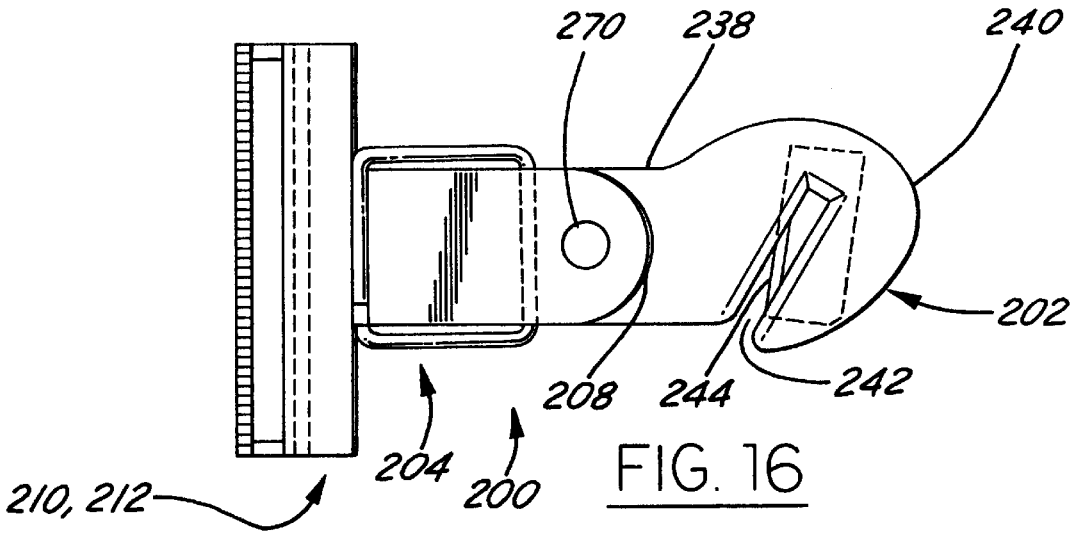
FIG. 16 is a bottom plan view of the first form of the second embodiment of the cutting and clipping tool according to the present invention.
Figure 17:
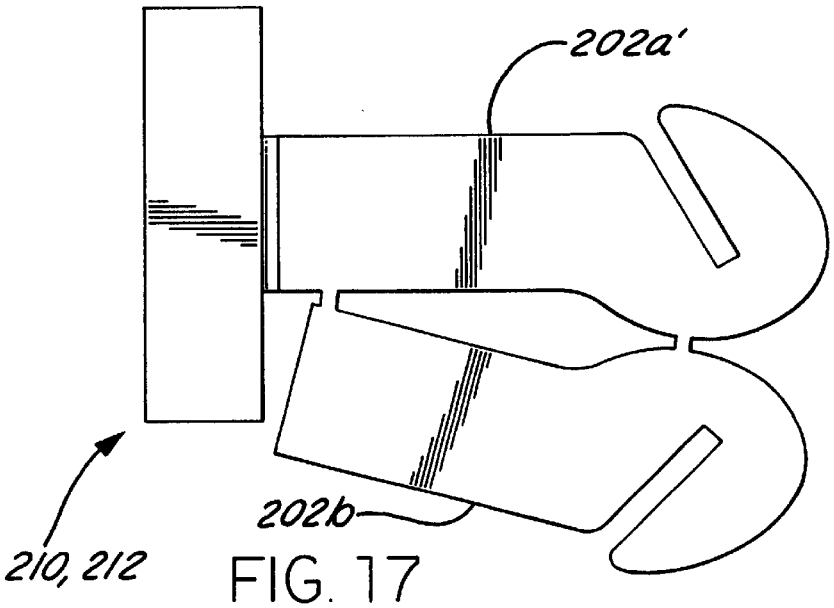
FIG. 17 is a top plan view showing the cutting tool of FIG. 13 in a preliminary stage of assembly.
Figure 18:
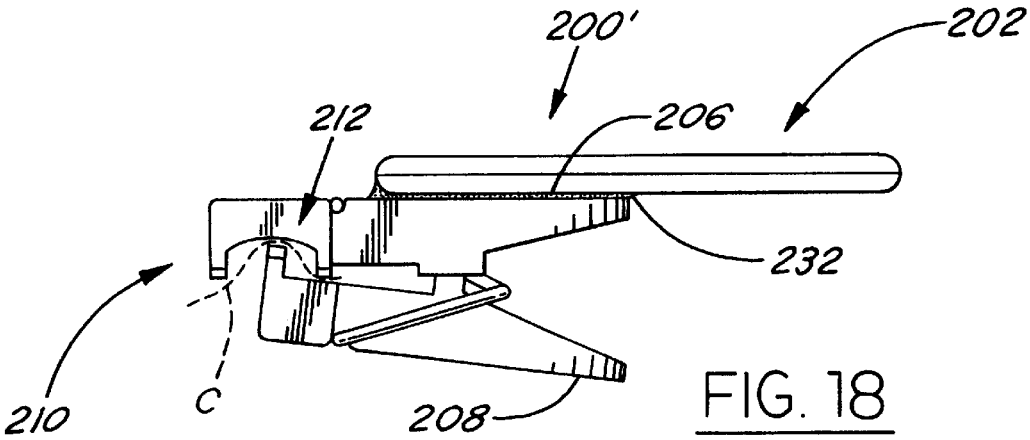
FIG. 18 is a side view of a second form of the second embodiment of the cutting and clipping tool according to the present invention.
Figure 19:
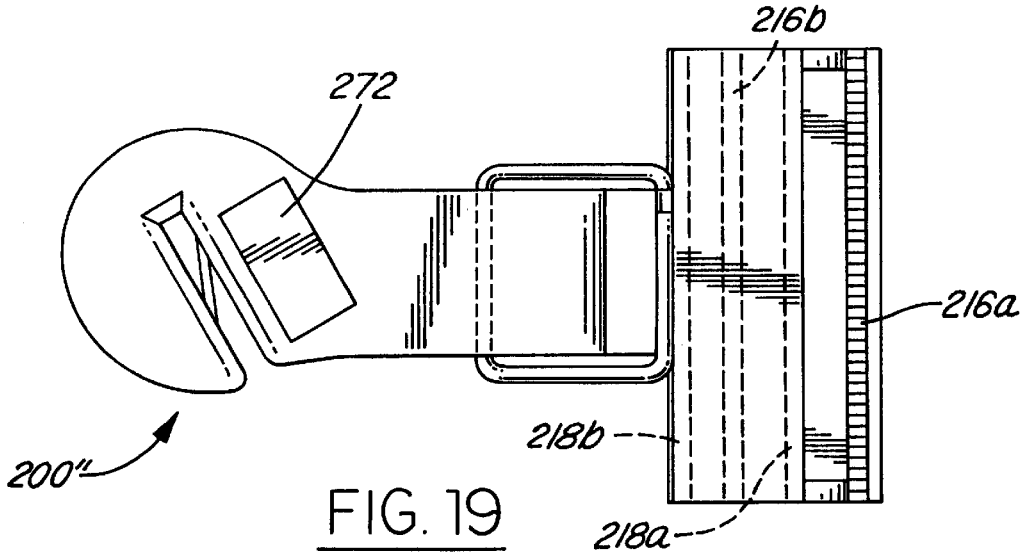
FIG. 19 is a top plan view of a third form of the second embodiment of the cutting and clipping tool according to the present invention.
Figure 20:
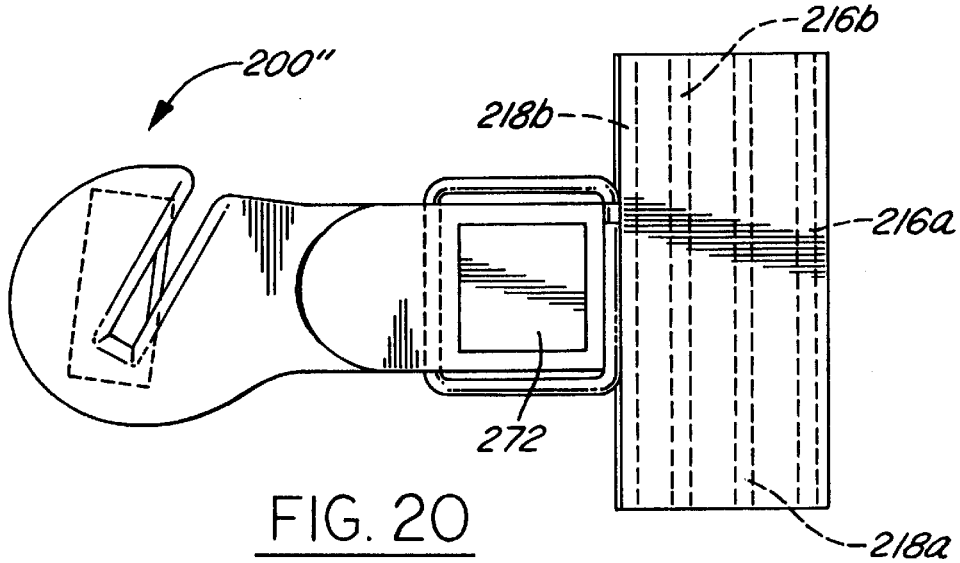
FIG. 20 is a bottom plan view of the third form of the second embodiment of the cutting and clipping tool according to the present invention.
Figure 21:
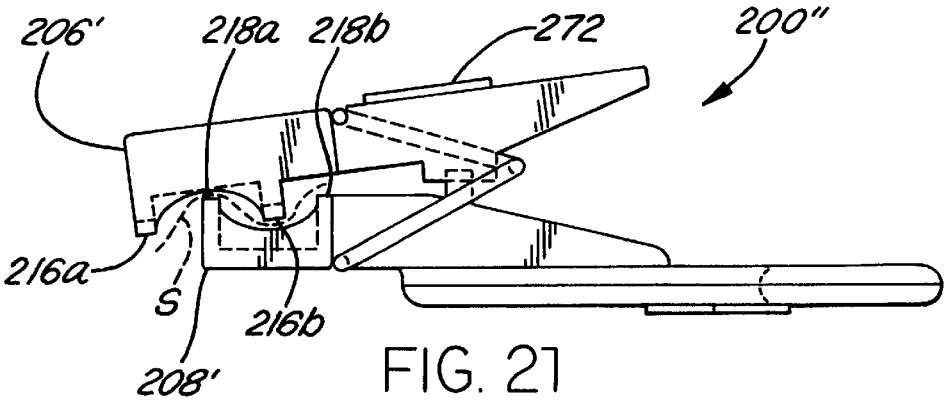
FIG. 21 is a side view of the third form of the second embodiment of the cutting and clipping tool according to the present invention, wherein two opposing pairs of serration rows provide an S-curve bag sealing bend.

Turning attention now to FIGS. 13 through 21 a second embodiment of the cutting and clipping tool according to the present invention will be discussed, wherein FIGS. 13 through 15 show a first form of the second embodiment of the cutting and clipping tool 200, wherein a three serration row arrangement provides a C-curve bag sealing bend, FIGS. 16 through 18 show a second form of the second embodiment of the cutting and clipping tool 200', wherein the three serration row arrangement also provides a C-curve bag sealing bend. FIGS. 19 through 21 show a third form of the second embodiment of the cutting and clipping tool 200", wherein a four serration row arrangement provides a superior S-curve bag sealing bend.

Figure 13A:
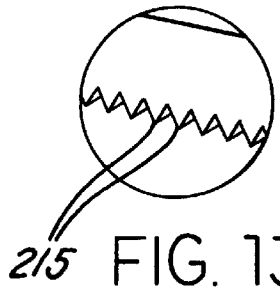
FIG. 13A is a detail view of circle 13A of FIG. 13.

A clipping tool 204 includes a first wing 206, and a second wing 208. At the end of the wings 206, 208 is a respective first and second jaw 210, 212. The first jaw 210 of the first wing 206 is provided with a pair of mutually spaced apart off-set serration rows 214, 216 (see detail of serrations 215 at FIG. 13A). The second jaw 212 of the second wing 208 is provided with a single center-set serration row 218. The spacing and location of the serration rows is such that the center-set serration row 218 is receivable between the off-set serration rows 214, 216 when the wings are in a closed state, as shown at FIG. 15. This three serration row arrangement provides a C-curve bag sealing bend, as shown at FIGS. 15 and 18.

Alternatively, the serration rows of the jaws may be configured as shown at FIGS. 19 through 21. Now, each jaw 206', 208' carries a respective off-set pair of serration rows 216*a,* 216*b,* 218*a,* 218*b,* wherein the serration rows mesh as shown at FIG. 21. This four serration row meshing causes a bag placed therein to undergo an S-curve sealing bending which is superior to the C-curve sealing bending provided a bag when the jaws of FIGS. 15 and 18 are closed thereupon because the added sealing bends result in a more assured sealing closure of the bag opening and tight gripping of the bag in the jaws.

Figure 1:
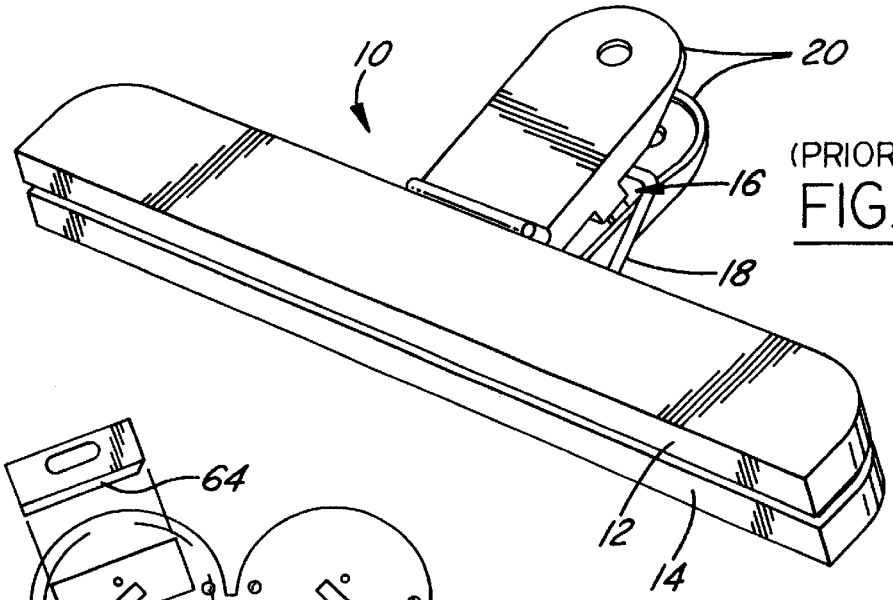
(PRIOR ART) FIG. 1
FIG. 1 is a perspective view of a prior art clipping device.

The wings 206, 208 are interconnected by a conventional rocking pivot 220, of the kind well known in the art and shown at FIG. 1. The pivot 220 allows the wings 206, 208 to be moved between an open state and a closed state, as discussed hereinabove. This movement in provided by hand manipulation of handles 222, 224 (which are integral portions of the wings 206, 208) in a mode analogous to FIG. 11.

The wings 206, 208 are biased toward the closed state by a spring 226. The spring 226 is preferably of spring steel wire, wraps about the wings and resides in slots formed in the wings in a manner known in the art.

In the first form of the second embodiment of the cutting and clipping tool 200, shown in FIGS. 15 through 17, one of the wings 206 integrally includes a cutting tool 202'. In the second form of the second embodiment of the cutting and clipping tool 200', the cutting tool 202 is adhered to one of the wings by (for example) an adhesive, as shown at FIG. 18.

The cutting tool 202 is identical to the cutting tool 102 described hereinabove, inclusive of two planar parts 202*a,* 202*b,* a head 240, a stem 238, a slot 242, and a blade 244 positioned in the slot at an acute angle. The stem 238 is adhered to one of the wings 206 by, for example, an adhesive 232, as shown at FIG. 18. The cutting tool 202' is similarly configured to the cutting tool 202, except now planar part 202*a'* is an integral part of wing 206 (see FIG. 15).

Operation of the second embodiment of the cutting and clipping tool 200, 200', 200" is as generally described previously. It is preferred to include a key chain hole 270 in one of the wings 208 to provide easy carrying in a purse or pocket. While the second embodiment may be any size the jaws may be made to any desired length (ranging for example from about 1.5 inches (as shown) to 6 inches or more), a small size (jaws of about 1.5 inches in length) is preferred for carrying on a key chain or for ladies to carry in their purse. Also, magnets 272 may be attached which allows placement on a refrigerator for ready reach.

Figure 28:
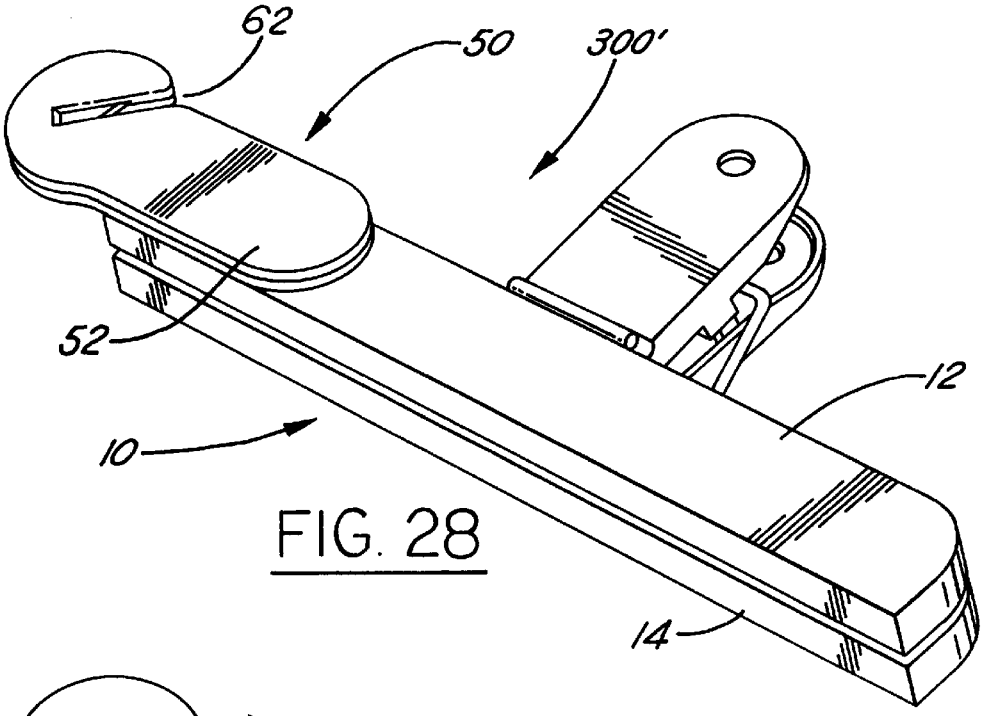
FIG. 28 is a perspective view of a second form of the third embodiment of the cutting and clipping tool according to the present invention.
Figure 29:
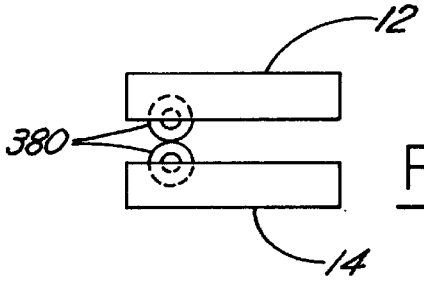
FIG. 29 is a detail side view of a first jaw variation of the cutting and clipping tool of FIG. 28.
Figure 30:
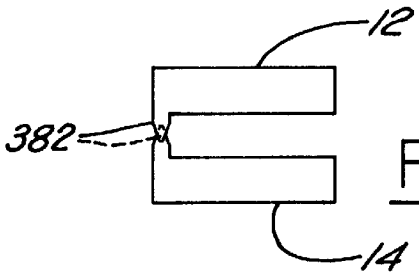
FIG. 30 is a detail side view of a second jaw variation of the cutting and clipping tool of FIG. 28.

Referring now to FIGS. 22 through 30, a third embodiment of the cutting and clipping tool according to the present invention is depicted, wherein FIGS. 22 through 27 depict a first form of the third embodiment of the cutting and clipping tool 300 and FIGS. 28 through 30 depict a second form of the third embodiment of the cutting and clipping tool 300'.

In a first variation of the first form of the third embodiment of the cutting and clipping tool 300, the clipping tool 304 is as described hereinabove with respect to the clipping tool 200" of FIGS. 19 through 21, wherein a first jaw 306 is pivotally connected to a second jaw 308 via a rocking pivot 320, the jaws are biased closed by a wire spring 326, and each jaw carries a pair of mutually spaced apart serration rows 316*a,* 316*b,* 318*a,* 318*b* which intermesh in the off-set manner of FIG. 21 so as to provide the aforementioned superior S-curve bag sealing bend. Handles 322, 324 integrally connect, respectively, with the jaws 306, 308.

The cutting tool 302 has two planar parts 302*a,* 302*b,* and a head 340 having a slot 342 and a blade 344 acutely angled in the slot. As in the above described cutting tool 202', the planar part 302*a* is an integral part of a jaw 308, wherein the head 340 is clear of the jaws so that a bag may be placed into the slot without interference by the clipping tool 304.

In a second variation of the first form of the third embodiment of the cutting and clipping tool, a cutting tool seat 332 is formed at one of the jaws 308' (see FIG. 23). The preferred cutting tool seat 332 is a pair of mutually separated rails 334, 336 having lips 334*a*, 336*a* which are structured to receive the stem 138 of the cutting tool 102 depicted at FIG. 7. The cutting tool seat 332 may hold the stem 138 received therein by an adhesive, friction or by a snap fit, as shown by way of example at FIGS. 27 and 28, wherein a first set of saw-teeth 338 on the stem 138' ratchet with respect to a complementary set of saw-teeth 340 in the cutting tool seat 332'.

FIG. 24 depicts a third variation of the first form of the third embodiment of the cutting and clipping tool, wherein the jaws are configured as in FIG. 15 so as to provide the aforesaid C-curve bag sealing bend, and wherein one jaw 308" has a center-set serration row 318*a'* and the other jaw 306' has a pair of mutually spaced off-set serration rows 316*a'*, 316*b'* such that the spacing and location of the serration rows is such that the center-set serration row 318*a'* is receivable between the off-set serration rows 316*a'*, 316*b'*.

FIG. 25 depicts a fourth variation of the first form of the third embodiment of the cutting and clipping tool, wherein the jaws are configured oppositely to FIG. 24, yet also provide the C-curve bag sealing bend, wherein one jaw 306" has a center-set serration row 316*a"* fitting into the other jaw 308'" which has a pair of mutually spaced off-set serration rows 318*a"*, 318*b'*, such that the spacing and location of the serration rows is such that the center-set serration row 316*a"* is receivable between the off-set serration rows 318*a"*, 318*b'*.

In the second form of the third embodiment of the cutting and clipping tool 300', the cutting tool 50 is conventional (see FIG. 4A) and the clipping tool 10 is conventional (see FIG. 1), wherein the handle (stem) 52 is glued to the jaw 12 whereby the slot 62 is free of the jaw so that a bag may be inserted therein without interference by the clipping tool. The jaws 12, 14 may carry resilient plastic tubes 380, or may each end in a serration row 382 which collectively intermesh in a manner known in the art.

It is to be understood that any of the embodiments and variations thereof may be combined with any other embodiment and variation thereof, and that the embodiments and variations thereof depicted and described herein are by way merely of preferred example and not limitation. It is to be further understood that by the term "integral" is meant an integrated, single piece construction.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A clipping and cutting tool comprising:

a clipping tool comprising:

a first jaw having a first handle connected to said first jaw;

a second jaw having a second handle connected to said second jaw;

a pivot pivotally interconnecting said first and second jaws so as to provide pivoting of said first and second jaws between a closed state and an open state; and a spring biasing said first and second jaws toward said closed state; and a cutting tool connected to said clipping tool, said cutting tool comprising:

a head having a slot, the slot being of substantially constant width;

a blade having a cutting edge located in said slot, said cutting edge extending entirely across said width of said slot at an acute angle with respect thereto; and a stem connected to said head, wherein said stem is connected to said clipping tool such that said slot is unobstructed by said clipping tool.

2. The cutting and clipping tool of claim 1, wherein said stem is integrally connected with said clipping tool.

3. The cutting tool of claim 2, wherein said stem is integrally connected with one of said first and second jaws.

4. The cutting and clipping tool of claim 2, wherein said stem is integrally connected with one of said first and second handles.

5. The cutting and clipping tool of claim 1, wherein said stem is adheringly connected with one of said first and second jaws.

6. The cutting and clipping tool of claim 1, wherein said stem is adheringly connected with one of said first and second handles.

7. The cutting and clipping tool of claim 1, further comprising a cutting tool seat formed in one of said first and second jaws, wherein said stem is received in said cutting tool seat to thereby connect said cutting tool to said clipping tool.

8. The cutting and clipping tool of claim 7, wherein said stem and said cutting tool seat are mutually structured to provide a snapping interface therebetween.

9. The cutting and clipping tool of claim 1, further comprising a cutting tool seat formed in one of said first and second handles, wherein said stem is received in said cutting tool seat to thereby connect said cutting tool to said clipping tool.

10. The cutting and clipping tool of claim 9, wherein said stem and said cutting tool seat are mutually structured to provide a snapping interface therebetween.

11. The cutting and clipping tool of claim 1, wherein said first jaw has a first serration row; and wherein said second jaw has a pair of mutually spaced apart second serration rows, wherein said first serration row is disposed between said second serration rows when said first and second jaws are at said closed state.

12. The cutting and clipping tool of claim 11, wherein said stem is integrally connected with said clipping tool.

13. The cutting and clipping tool of claim 11, wherein said stem is adheringly connected with said clipping tool.

14. The cutting and clipping tool of claim 11, further comprising a cutting tool seat connected to said clipping tool, wherein said stem is received in said cutting tool seat.

15. The cutting and clipping tool of claim 1, wherein said first jaw has a first serration row and a second serration row separated from said first serration row; and wherein said second jaw has a third serration row and a fourth serration row separated from said third serration row, wherein when said first and second jaws are at said closed state, said third serration row is disposed between said first and second serration rows and said second serration row is disposed between said third and fourth serration rows;

wherein when a bag is placed between said first and second jaws and said first and second jaws are in said closed state, said first, second, third and fourth serration rows impose an S-curve sealing bend on the bag.

16. The cutting and clipping tool of claim 15, wherein said stem is integrally connected with said clipping tool.

17. The cutting and clipping tool of claim 15, wherein said stem is adheringly connected with said clipping tool.

18. The cutting and clipping tool of claim 15, further comprising a cutting tool seat connected to said clipping tool, wherein said stem is received in said cutting tool seat.

* * * * *